United States Patent [19]

Diesel

[11] 4,363,683

[45] Dec. 14, 1982

[54] PROCESS FOR AFFIXING MARKER TO FABRIC

[76] Inventor: Nelson P. Diesel, 816 Dutch Mill, Ballwin, Mo. 63011

[21] Appl. No.: 180,113

[22] Filed: Aug. 21, 1980

Related U.S. Application Data

[63] Continuation-in-part of Ser. No. 51,836, Jun. 6, 1979, abandoned.

[51] Int. Cl.[3] ..... B65H 81/00; A41D 1/00; A23L 1/16; B05D 1/02

[52] U.S. Cl. ..... 156/184; 2/243 B; 118/325; 427/179; 427/143; 427/208.4; 427/424; 156/334

[58] Field of Search ..... 156/60, 249, 191, 247, 156/269, 334; 2/243 R, 243 B; 427/143, 255.2, 177, 179, 207.1, 208.4, 424; 428/352, 343; 33/12, 15, 17; 118/229, 235, 326, 325, 315, 313, 314, 305

[56] References Cited

U.S. PATENT DOCUMENTS

| | | | |
|---|---|---|---|
| 1,902,539 | 3/1933 | Brauer | 427/143 |
| 3,282,727 | 11/1966 | Crone, Jr. et al. | 428/352 |
| 3,628,987 | 12/1971 | Nakata | 427/208.4 |
| 3,821,055 | 6/1974 | Fairbanks et al. | 2/243 B |
| 3,991,002 | 11/1976 | Sadlo | 156/334 |

*Primary Examiner*—Edward C. Kimlin
*Assistant Examiner*—Louis Falasco
*Attorney, Agent, or Firm*—Jerome A. Gross

[57] ABSTRACT

A method for applying adhesive to a printed paper commercial garment-making rolled pattern marker includes spraying the back (upward facing) side of the marker with a fast-drying adhesive and as the upper surface of the applied adhesive becomes tacky, rolling the marker upon itself. The adhesive remains tacky on the rolled-up marker for a relatively long time, so that it may be used later, when desired, by simply unrolling it tacky side down on top of the fabric to be cut. Apparatus for applying the adhesive includes a variable speed paper-handling mechanism which transfers the marker along a path from an upper feed roll, forward and downward to a take-up roll, and a multiple-nozzle airless spraying mechanism which applies the adhesive to the back side of the marker. The application and paper travel rates are such that the outer surface of the adhesive becomes tacky before the marker is rolled upon itself on the take-up roll. A spray tunnel, which protects the spray path, may be raised vertically for access to the feed roll.

2 Claims, 5 Drawing Figures

PROCESS FOR AFFIXING MARKER TO FABRIC

REFERENCE TO RELATED APPLICATIONS

This application is a continuation-in-part of application Ser. No. 51,836, filed June 6, 1979, entitled "Process and Mechanism for Affixing Marker to Fabric", abandoned.

BACKGROUND OF THE INVENTION

The present invention relates to garment making, and relates more specifically to the practice of securing the paper pattern, known as a marker, to fabric in preparation for cutting.

In commercial garment-making, the operation of cutting the fabric into pieces for garments begins with spreading a bundle of fabric, one to 200 layers or plies thick, on a cutting table, which may be as long as 150 feet and is usually about 6 feet wide. Then a long paper pattern or marker is positioned on the top layer of fabric and cutting blades cut the layers of fabric along the lines printed on the front surface of the marker.

To assure accurate cutting the marker must not shift relative to the fabric. Garment markers have secured the marker to the fabric by stapling, but this may leave holes in the fabric. Sometimes adhesives are applied either to the marker or to the top layer of fabric immediately prior to placing the marker on the fabric, but the wet adhesive may damage the fabric. Another approach has been to utilize markers having a heat-sensitive backing which is activated by hot irons after the marker has been placed in position on the fabric. However, modern computerized marker layout devices often utilize electrostatic or photographic processes not compatible with heat-sensitive paper. For each of these methods of securing the marker, the labor required is extensive; eliminating part of this required labor could greatly lessen garment-making costs.

SUMMARY OF THE INVENTION

A principal purpose of the present invention is to provide a method by which a marker may be easily, quickly and securely affixed to a bundle of fabric and removed after cutting without damaging the fabric. Another purpose is to provide apparatus for preparing markers which have those characteristics.

Briefly summarizing, the present invention method includes the steps of rotatably securing a printed marker on a feed roll, manually drawing the outer end of the marker past a spray mechanism aimed toward its back upward-facing side, and securing the end to a take-up roll. The marker is then continuously mechanically drawn from the feed roll to the take-up roll while adhesive is sprayed on its back side. Adhesive application and the rate of paper travel are fixed so that the adhesive dries to a slightly tacky state; it will thereafter separate cleanly from an overlaying layer of paper. As it is rolled, adhesive surface outward, on the take-up roll, such drying to a slightly tacky state is achieved before the adhesive is overlaid; after which the adhesive is substantially shielded from the air by the rolled paper outside it and remains tacky for a long time. When it is desired to use the marker, perhaps several weeks later, it is simply unrolled on the fabric, tacky side down.

Preparation of the marker for affixation to the fabric is performed by the presently-described adhesive-applying apparatus whose preferred embodiment comprises a power-driven paper-handling mechanism which supports a horizontal feed roll at the upper rear, and a horizontal take-up roll at the lower front, and has a rear idler, preferably slightly above the level of the take-up roll, providing a downward sloping paper travel path so that observation of the upper back side of the paper is facilitated during application of the adhesive. Along the path of paper travel from the feed roll to the take-up roll, an airless spraying mechanism having a plurality of nozzles directed downward toward the paper applies a fast-drying adhesive to its back side. The adhesive, and particularly its upper surface, contacts the opposite, printed side of the marker as the marker is rolled onto the take-up roll. The spray path is protected by a vertical spray tunnel, which may be raised to permit unobstructed manual feeding of the leading end of the marker from the feed roll to the take-up roll, where the end is then secured to the take-up roll. Below the downward-slanting paper travel path, a fan draws excess adhesive into a disposable filter.

DESCRIPTION OF THE PREFERRED EMBODIMENT

Figure 1:
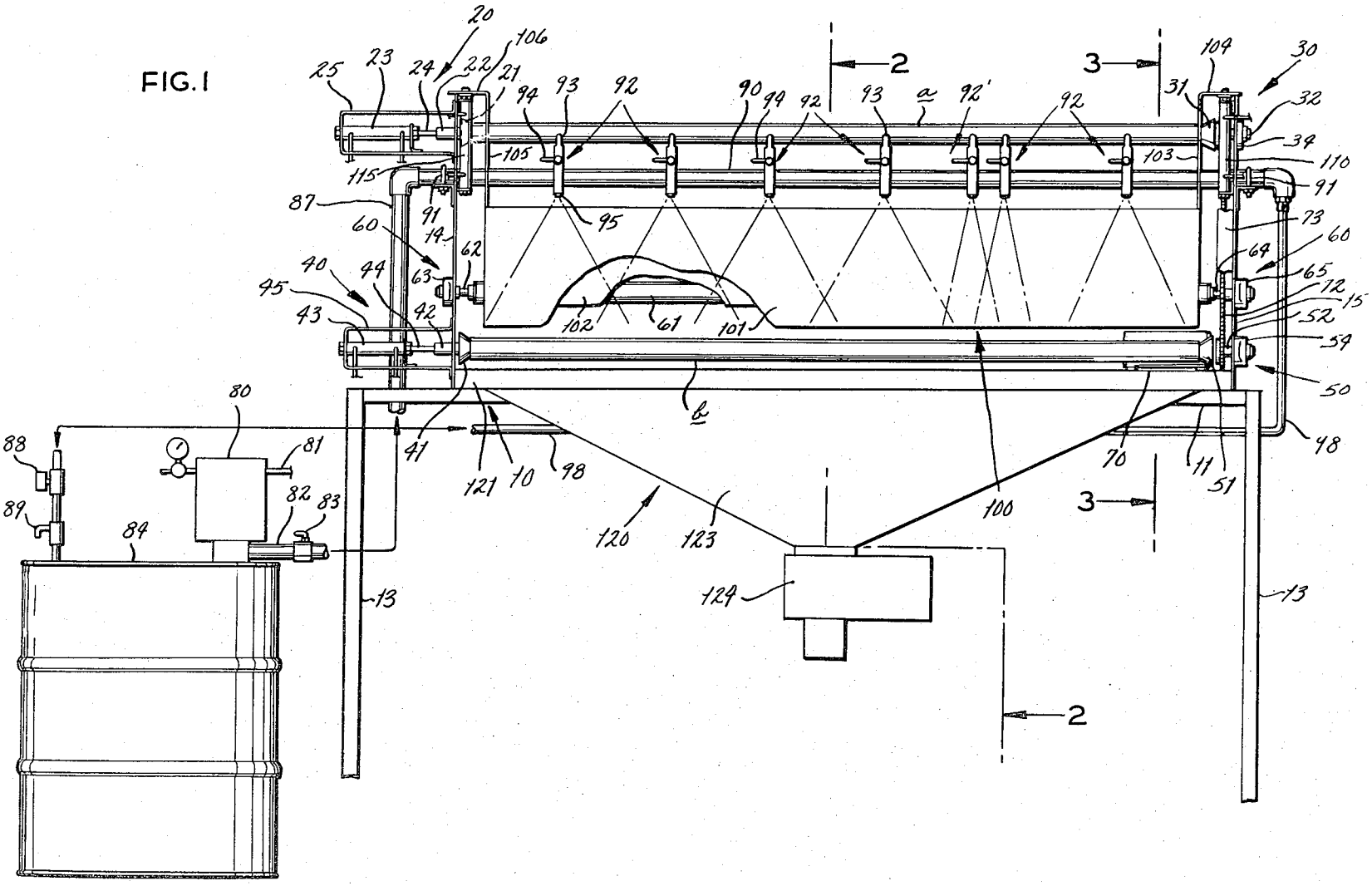
FIG. 1 is a front elevation of the preferred embodiment of apparatus for applying adhesive to the back side of a garment-making marker, described below.
Figure 3:
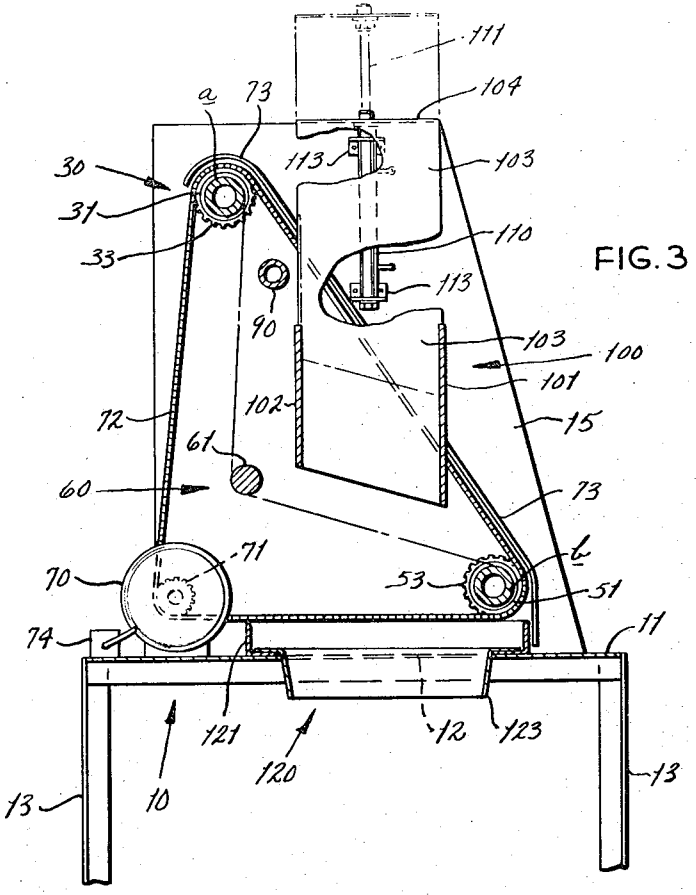
FIG. 3 is a cross-section taken along line 3—3 of FIG. 1; the right side of the spray tunnel is partially broken away.
Figure 2:
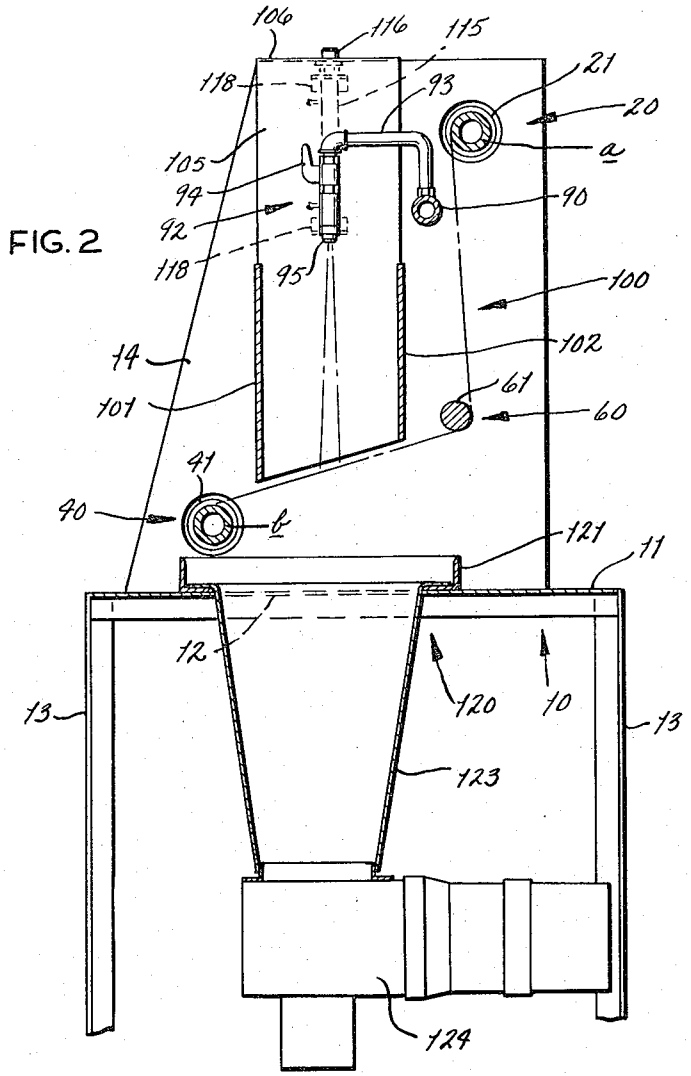
FIG. 2 is a cross-section taken along line 2—2 of FIG. 1.

The preferred embodiment of the present inventive apparatus, shown in FIGS. 1–3, for applying adhesive to pre-printed garment-making markers, is mounted upon a frame or work table 10, which is approximately 8 feet long and 3½ feet wide. The table is provided with a table top 11 which is supported by legs 13 and has a longitudinal slot 12. The table top 11 bears a left support plate 14 near its left end and a right support plate 15 near its right end, each extending upward vertically about 2½ feet and separated by about 7 feet.

Figure 4:
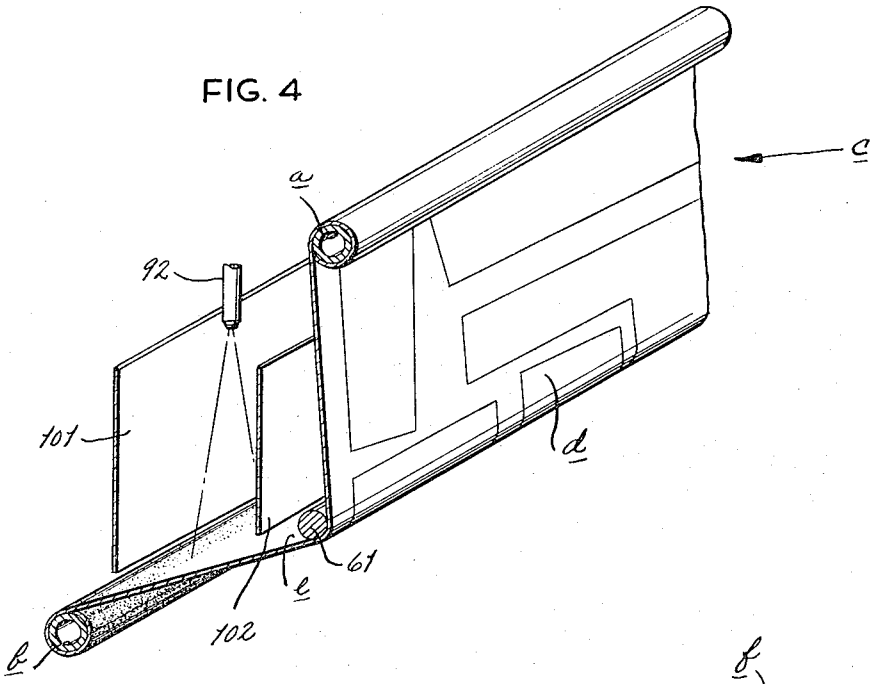
FIG. 4 is a partial schematic view which demonstrates the method in which a paper marker is drawn from a feed roll past nozzles which spray adhesive on the paper, and then is re-rolled on a take-up roll.

The support plates 14, 15 mount between them a paper transfer mechanism which delivers the paper markers from a feed roll a to a take-up roll b, as shown schematically on FIG. 4. This mechanism includes a feed roll support assembly made up of a left feed roll support 20 and a right feed roll support 30 positioned along a horizontal feed axis at the upper aft ends of the support plates 14, 15. The left feed roll support 20 includes a core holder 21 of a truncated conical shape, as shown in FIG. 1, and of sufficient size to accept upon it the hollow plastic cores upon which garment-making markers are rolled. The core holder 21 has an inner bearing (not shown) mounted on a spacer shaft 22 which extends outward through a bore in the left support plate 14 to the horizontal shaft 24 of an air cylinder 23, which is secured on the outer side of the left support plate 14 by a mounting bracket 25. The bore in the left support plate 14 is of sufficent diameter to permit retraction of the core holder 21 through the support plate 14. A compressed air supply, not shown, is utilized to operate the air cylinder 23. Flow controls on the cylinder 23 (not shown) may be provided to control the rate of its extension and retraction.

The right feed roll support 30 includes a similar conical core holder 31 which is instead fixed on a drive shaft 32. The shaft 32 bears a sprocket 33 outward of the core holder; outward of the sprocket 33 the shaft 32 extends through the right support plate 15 and is received by a flange bearing 34 mounted on the outer side of the right support plate 15. A feed roll a is shown mounted between the core holders 21, 31.

The paper transfer mechanism further includes a take-up roll support assembly made up of a left take-up roll support 40 and a right take-up roll support 50 mounted on the support plates 14, 15 at the lower forward side of the work table 10 along a horizontal take-up axis. The left take-up roll support 40 includes a core holder 41 mounted rotatably by an inner bearing on a spacer shaft 42 which is coupled to the horizontal shaft 44 of an air cylinder 43. The air cylinder is mounted on the outer side of the left support plate 14 by a mounting bracket 45, with its shaft 44 and the spacer shaft 42 together extending inward through a bore in the support plate 14. The bore is of sufficient diameter to permit retraction of the core holder 41 through the bore.

The right take-up roll support 50 likewise includes a core holder 51 fixed on a drive shaft 52. Outward of the core holder 51, the drive shaft 52 bears a drive sprocket 53 and continues outward through the right support plate 15 where it is borne by flange bearings 54 mounted on the outer side of the plate 15.

At the aft end of the support plates 14, 15, almost directly below the feed roll supports 20, 30 and slightly above the level of the take-up roll supports 40, 50, is provided a horizontal idler roll assembly 60 which includes a roller 61 extending between the left support plate 14 and the right support plate 15. At the left end of the roller 61 a shaft 62 extends through the left support plate 14 into a flange bearing 63 mounted on the outer side of the support plate 14, and at the right end of the roller 61 a shaft 64 extends through the right support plate 15 into a flange bearing 65 mounted on the outer side of the plate 15.

A variable-speed dc electric motor 70 is mounted on the work table top 11 at its right rear inward of the right support plate 15 and is provided with a speed control 74. The motor 70 has a drive sprocket 71 which is aligned with the right feed roll sprocket 33 and right take-up roll sprocket 53 and drives them by a roller chain 72. A chain guard 73 is provided along the length of the forward side of the drive chain 72 between the feed roll sprocket 33 and take-up roll sprocket 53.

The apparatus further includes an adhesive spraying mechanism whereby adhesive may be applied to the marker as it is delivered from the feed roll a to the take-up roll b. The spraying mechanism includes an airless air-motor-driven pump 80, such as manufactured by The DeVilbiss Company of Toledo, Ohio, driven by the same compressed air supply utilized for the air cylinders 23, 43 and producing output pressures exceeding 1,000 psi with an inlet-to-outlet pressure ratio of approximately 1:20. The pump 80 has a compressed air inlet 81 and a high-pressure fluid outlet 82 which has a high-pressure outlet valve 83 to provide shut-off. The pump 80 is mounted on a 55-gallon storage drum 84, from which it draws the adhesive to be sprayed, as shown in FIG. 1. If desired, the pump 80 may be mounted independently of the drum 84 and a second inlet to the pump 80 for introduction of cleaning solvent may be provided.

A coupling line 87 leads from the high-pressure valve 83 on the pump outlet 82 to the left end of a manifold 90, which extends almost the entire length of the work table 10, passing through both support plates 14, 15, where it is mounted to them slightly below and forward of the feed roll supports 20, 30 by U-bolt clamps 91. The manifold 90 bears seven nozzle assemblies 92, six of which are spaced evenly across the length of the manifold 90 approximately 12 inches apart, for spraying paper of a maximum width of 72 inches. The other nozzle assembly 92' is spaced about 3 inches inward of that nozzle assembly 92 which is second from the right. Each nozzle assembly 92, 92' consists of a connector 93 leading out of the upper side of the manifold 90 and curving forward and downward to connect to a high-pressure valve 94, which permits selection of those nozzles to be utilized for spraying a marker of a particular width. Each valve is coupled through a check valve (not shown) to an airless spray nozzle 95 which is aimed substantially vertically downward so as to direct its spray to approximately mid-way between the idler roller 61 and the mounted take-up roll b. Each nozzle 95 produces a knife-edge spray pattern about ½ inch wide at a spraying distance of 12 inches; the six evenly spaced nozzle assemblies 92 each producing a pattern about 12 inches long and the other nozzle assembly 92' about 6 inches long. Thus, for spraying 54 inch wide material, one would utilize the first four evenly spaced nozzle assemblies 92 (counting from the left) and the next following assembly 92'.

The right end of the manifold 90 is coupled to a return line 98 which leads back beneath the work table to the storage drum 84 through a presssure regulator 88 and return valve 89. This forms a loop-type supply whereby almost constant pressure may be maintained across the entire length of the manifold 90. If desired, a cleanout sump may be interposed between the pressure regulator 88 and return valve 89.

To protect the spray from air currents on its path between the tips of the nozzles 95 and the marker upon which it is sprayed, a vertically-mounted spray tunnel, generally designated 100, is provided, constructed of light gauge sheet metal. The tunnel 100 includes a rectangular front panel 101 and a similar rectangular rear panel 102, both extending about 6 feet lengthwise along the work table 10. The enclosure is completed by a right side panel 103, which extends upward above the front and rear panels 101, 102 to terminate in an outward-facing upper flange 104 and a left side panel 105 extending upward like the right side panel 103 to terminate in an outward-facing upper flange 106.

The outward-facing flange 104 of the right side panel 103 is mounted to the end of the shaft 111 of an air cylinder 110. The casing of the cylinder 110 is mounted on the inner side of the right support plate 15 by mounting brackets 113. Likewise, an air cylinder 115 is mounted on the inner side of the left support plate 14 by mounting brackets 118, with the end of its shaft 116 fixed to the outward-facing upper flange 106 of the left side panel 105. These air cylinders 110, 115 are also powered by the same compressed air supply used for the pump 80 and may be regulated by similar flow controls (not shown).

In order to catch any adhesive overspray, a trough assembly, generally designated 120, is provided on the work table 10 beneath the spray tunnel 100. The trough assembly includes a filter mount 121, made up of metal angles arranged about the table top longitudinal slot 12. The filter mount 121 will accept a disposable filter, known as an andrea filter, not shown. Beneath the level of the work table top 11, a tapering spray trough 123 leads downward from the slot 12 to a squirrel-cage fan 124 which draws the overspray downward through the filter.

The above-described apparatus is utilized in garment making to prepare a pre-printed, pre-rolled garment-making marker for adherence to the upper side of an elongated bundle of fabric preliminary to cutting the fabric. An elongated garment-making marker, generally designated c, is conventionally of paper construction on which the front side d, as shown in FIG. 4, is pre-printed with the pattern to be cut into the fabric. The back side e of the marker is blank, and the front side d may be left with blank ends, at least the final end (that is, the outer end after spraying and rolling) being blank for a length equal to or greater than the circumference of the roll. The markers are manufactured in various standard widths up to 72 inches, corresponding to widths of fabric, and are generally stored in rolled condition.

In preparing the marker for adherence to the fabric, by using the above-described apparatus, the pre-rolled marker is first mounted for rotation along the feed axis on the feed roll supports 20, 30 by extending the spray tunnel air cylinders 110, 115 to raise the spray tunnel 100, retracting the feed roll air cylinder 23, slipping the rolled marker between the core holders 21, 31, and then extending the air cylinder 23 until the marker is secured on the core holders 21, 31 by its tubular plastic core. Likewise, an empty core is mounted along the take-up axis on the take-up roll supports 40, 50 by similarly manipulating the take-up roll air cylinder 43 to secure the core between the core holders 41, 51.

Next, the dc electric motor 70 is switched on momentarily to unroll the leading end of the marker, which was left blank on its front side d near the end. The end of the marker is manually drawn beneath the idler roller 61 and secured to the empty take-up roll core, already mounted on the take-up roll supports 40, 50 so that it will be re-rolled with its back side a presented outward (i.e. upward). The marker has thus been drawn by the spraying mechanism so that it nozzles 95 are directed to spray adhesive downward onto the unprinted back side of the marker.

The spray tunnel 100 is then lowered and the electric motor 70 is switched on to run continuously, drawing the marker from the feed roll a to and winding it upon the take-up roll b. At the same time, the airless pump 80 and the fan 124 for the overspray trough 120 are likewise actuated, causing adhesive to be sprayed through those nozzles 95 whose valves have been opened for the width paper utilized. The back (upward facing) side of the marker is drawn past the nozzles 95 as adhesive is sprayed onto it, as shown in FIG. 4. The apparatus may be pre-programmed to commence spraying the adhesive onto the marker when the pre-printed pattern begins to be drawn past the nozzles 95, or this step may be done manually.

In the preferred embodiment, the adhesive utilized is of a quick-setting type having a latex base. Use of the airless spraying system assures that the adhesive does not dry before leaving the nozzles.

Generally, best results have been obtained by employing an adhesive dissolved in an organic liquid which is relatively volatile. Such liquid preferably has a boiling point above the ambient temperature at which the adhesive spray is applied but is sufficiently volatile to volatilize from the outer surface of the adhesive droplets to provide a solidified skin which is tacky. The organic liquid trapped within the adhesive droplets tends to remain in the droplets while the adhesive is in contact with the preprinted paper surface, thus maintaining the adhesive which has been found to be suitable for the practice of this invention is a solution of a rubbery copolymer of 30% by weight styrene and 70% by weight of butadiene in 1, 1, 1, trichloroethylene; the copolymer being further characterized in that a 25% by weight solution thereof in toluene has a viscosity of about 4,000 centipoises at 25° C. Generally, it is possible to use an adhesive solution having an adhesive solid content of about 10 to about 20% by weight, but it is preferable to use a solution having an adhesive solid content of about 12 to about 15% by weight in order to obtain the optimum properties for the practice of this invention. Other suitable adhesive materials will be apparent to one skilled in the art from the description herein given. Generally, water based adhesives have not been found to be suitable in the practice of this invention since the water tends to strike through the paper and adversely affects the performance of the adhesive. By varying nozzle sizes, manifold pressures, the adhesive content, and the rate that the paper is drawn past the nozzles, the proper amount of adhesive is sprayed upon the paper. Almost immediately upon reaching the paper, the outer surface of the adhesive becomes tacky; it continues to partially dry or "set" in the air as the marker is drawn toward the take-up roll.

As the marker continues to be drawn forward, it is re-rolled upon the take-up roll with its back side presented outward (i.e. upward) after the outer surface of the sprayed adhesive has become sufficiently tacky that, while adhering to the back side of the marker, the inner, pre-printed side of an overlaying layer may be separated cleanly from the back side of an underlying layer. In the preferred embodiment, a paper travel rate of 30 feet per minute was found best to provide this result.

After adhesive has been applied to the back side a of the marker c along the entire printed pattern portion and only the blank trailing end of the marker remains, the spraying is discontinued by switching off the pump 80 and closing the valve 83. Upon continuing to draw the marker to and upon the take-up roll, the blank end of the marker, which is not sprayed with adhesive, overlays the outer layer of the sprayed portion of the marker. Adhesive on the marker near the end of the printed portion, which might otherwise be on the outside of the roll, is shielded from drying by the overlaying blank end. For this purpose, the length of the blank end should exceed the circumference of the marker rolled on the take-up roll.

When the transfer of the paper to the take-up roll is complete and the drive motor 70 is turned off, the rolled-up marker is removed, on the core, from the take-up roll supports 40, 50 after retracting the air cylinder 43. Since rolling the marker upon itself provides an overlaying shield for each layer of adhesive, the adhesive retains sufficient tackiness to adhere to cloth when positioned for cutting, as described below. The rolled-up marker can be stored for a substantial period of time, say two weeks, until cutting of the fabric is to be done. More efficient work flow may thus result. If desired, the adhesive may be applied at a remote or central location or at the place of manufacture of the supplier of the pre-printed markers.

Figure 5:
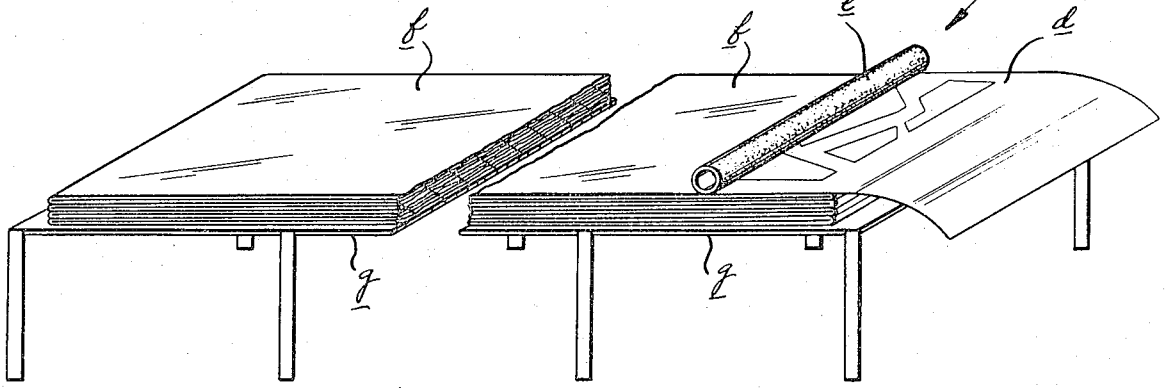
FIG. 5 shows a rolled marker, to which adhesive has been previously applied by the method described below, being unrolled upon a bundle of fabric on a cutting table.

In the cutting room, the unprinted back side of the marker is adhered to the upper side of an elongated bundle of fabric f spread upon a cutting table g, as shown in FIG. 5. To accomplish adherence, the prepared marker c is positioned on the bundle of fabric with its tacky back side a down, transversely to the elongated bundle f, with its ends aligned with the bundle sides, and the end of the pattern portion on its front side d aligned with the end of the bundle f. Finally, the marker c is progressively unrolled and smoothed upon the upper side of the bundle f. A simple way of carrying this out is to unroll a few feet of the printed portion of the marker on the take-up roll, carefully aligning its sides with the sides of the bundle f. Then the remainder of the roll may be rapidly unrolled until it is expended as it reaches the opposite end of the cutting table g. As the unrolling progresses, smoothing of the marker c to remove any air bubbles may be required. Since the adhesive was sprayed onto the paper marker by high pressure and permitted to become tacky before being re-rolled on the take-up roll, the back side cleanly separates from the overlaying front side when it is so unrolled for use.

The above-described apparatus presents certain advantages in preparing garment-making markers for adherence to fabric. The arrangement of rollers provides a simple paper-transfer mechanism which is easily threaded in preparing the machine to apply the adhesive. In the embodiment shown, the placement of the idler roller 61 slightly above the level of the take-up roll assembly provides a forward and downward sloping paper travel path which permits inspection of the upper surface of the marker as it passes to the take-up roll, to determine whether any malfunction in spraying has occurred. However, other roll locations may be chosen for convenience, considering for example the size and weight of the markers to be sprayed. An airless spraying mechanism is especially suited for the quick-setting type of adhesive utilized.

The vertically-mounted spray tunnel protects the adhesive spray directed downward onto the marker from air currents which might deflect the spray path. When the air cylinders are extended to raise the spray tunnel, access to the feed roll, positioned at the upper rear of the apparatus, is provided. A new marker on a hollow plastic core may be easily put into place on the feed roll supports 20, 30 when the spray tunnel is raised. Likewise, raising the spray tunnel facilitates the manual drawing of the marker downward around the idler roller 61 and forward to the take-up roll b to set up the apparatus for applying the adhesive.

The advantages of the present inventive method are many. Previous methods of securing the marker to the fabric might damage the fabric, while the present inventive method does not; the tacky adhesive separates from the cloth, after the cutting has been completed, cleanly and without causing any damage. Other methods which may overcome that problem require a great deal more labor than the present process. By applying the adhesive by a spray method as it is transferred from one roll to another, the cumbersome manual labor required to apply adhesive or to actuate a heat-sensitive backing on the long garment-making markers is eliminated. Further, rotating the take-up roll axis below the plane in which the marker's backside is presented for spraying, does more than provide visibility of and access to the spray plane; it effectively lengthens, by one circumference of the re-rolling marker, the path from spraying on the marker's unprinted side to overlaying with the printed side of the next layer of the rolling marker. This physical arrangement affords added time for the adhesive to become tacky with minimum length of flow path in the machine.

The method of this invention has been used successfully in affixing a marker to a large variety of fabric styles made from a large variety of natural and synthetic fibers or yarns, including knitted and/or woven fabrics made from cotton, polyester-cotton, wool, rayon, normex or polyester yarns.

Modifications of the present invention will be apparent to persons skilled in the art. For example, where the marker is so long that the diameter of the roll increases when the marker is rolled on it, only the take-up roll may be driven, while the feed roll assembly is provided with a drag brake. In another embodiment of the invention, involving the use of long markers (and thus larger diameter rolls) the feed roll a can be mounted on the side of work table 10, preferably at a level below idler roller 61, so that the paper initially follows an upward path prior to spraying adhesive thereon. In the same embodiment, the take-up roll b can be mounted on the outer side of work table 10 so that the paper marker is drawn down to it from idler roller 61. Moreover, an additional idler roller can be positioned between idler roller 61 and such take-up roll, for example, at a position such as illustrated for take-up roll b in FIG. 2. Other types of spraying apparatus might be substituted. Other means for supporting and driving the rollers may be utilized, and their relative positions may be modified. The apparatus might be adapted for use with garment-making markers not furnished by the supplier on rolls by progressively drawing the marker by the spray nozzles and rolling it upon a roller, from which it may be conveniently unrolled when it is to be used. From these examples and the above disclosure, other modifications will suggest themselves.

I claim:

1. A method of preparing a pre-printed, pre-rolled garment-making marker having a blank end for adherence to the upper side of an elongated bundle of fabric preliminary to cutting, comprising the steps of mounting the pre-rolled marker for rotation on a feed axis, unrolling the marker from the feed axis and drawing it in a plane past transversly-aligned adhesive-spraying nozzles directed at the unprinted back upward facing side of the marker, spraying adhesive onto the back side of the marker as it is drawn past the nozzles, commencing partial drying of the sprayed adhesive then, re-rolling the marker adhesive side outward upon a take-up roll mounted for rotation on a take-up axis below the level of such plane as soon as the sprayed adhesive becomes sufficiently tacky that the sprayed back side will thereafter separate cleanly from the printed front side of the marker, discontinuing spraying the marker after adhesive has been applied to its back side along the entire printed pattern portion and only said blank end remains, continuing to draw the marker to and upon the take-up roll until the blank end of the marker overlays the outer layer of the sprayed portion of the back side of the marker, and removing the marker so re-rolled from said take-up axis.

2. The method defined in claim 1, wherein the adhesive is a copolymer of substantally 30% by weight of styrene and substantially 70% by weight of butadiene.

* * * * *